US005123346A

United States Patent [19]

Schneider

[11] Patent Number: 5,123,346

[45] Date of Patent: Jun. 23, 1992

[54] DAMPENING SYSTEM

[75] Inventor: Georg Schneider, Wurzburg, Fed. Rep. of Germany

[73] Assignee: Koenig & Bauer Aktiengesellschaft, Wurzburg, Fed. Rep. of Germany

[21] Appl. No.: 646,218

[22] Filed: Jan. 28, 1991

[30] Foreign Application Priority Data

Feb. 5, 1990 [DE] Fed. Rep. of Germany ..... 4003412

[51] Int. Cl.[5] ..... B41L 25/00

[52] U.S. Cl. ..... 101/148; 101/352; 101/351; 101/209

[58] Field of Search ..... 101/147, 148, 349-352, 101/206-209

[56] References Cited

U.S. PATENT DOCUMENTS

| | | | |
|---|---|---|---|
| 3,508,486 | 4/1970 | Norton | 101/148 |
| 3,688,694 | 9/1972 | Preuss et al. | 101/148 |
| 4,351,236 | 9/1982 | Beisel et al. | 101/148 |
| 4,440,081 | 4/1984 | Beisel | 101/148 |
| 4,671,175 | 6/1987 | Zimmer et al. | 101/148 |
| 4,741,269 | 5/1988 | Aylor et al. | 101/148 |
| 4,905,593 | 3/1990 | Gollinger et al. | 101/148 |
| 4,922,818 | 5/1990 | Junghans | 101/148 |
| 5,042,377 | 8/1991 | Palecek et al. | 101/148 |
| 5,046,418 | 9/1991 | Koehler et al. | 101/148 |

FOREIGN PATENT DOCUMENTS

| | | |
|---|---|---|
| 3526236 | 5/1979 | Fed. Rep. of Germany . |
| 7814099 | 1/1987 | Fed. Rep. of Germany . |

*Primary Examiner*—Edgar S. Burr
*Assistant Examiner*—Christopher A. Bennett
*Attorney, Agent, or Firm*—Jones, Tullar & Cooper

[57] ABSTRACT

A dampening system for a printing press uses a dampening fluid spray system to apply dampening fluid to a first of several serially arranged transfer rollers. The dampening fluid is carried by these transfer rollers to a dampening forme roller and then to a plate cylinder. The surfaces of the dampening forme roller and the several transfer rollers after the first such transfer roller are oleophilic. Spaced levers adjustably support several of the transfer rollers and the dampening forme roller.

7 Claims, 3 Drawing Sheets

DAMPENING SYSTEM

FIELD OF THE INVENTION

The present invention is directed generally to a dampening unit for an offset printing press. More particularly, the present invention is directed to a brush type dampening system. Most specifically, the present invention is directed to a dampening fluid spray system. The dampening fluid is removed from the surface of a dampening fluid pan roller by a brush roller and is transferred as a fine spray of dampening fluid onto a hydrophilic surface of a first dampening fluid transfer roller. Several subsequent dampening transfer rollers, which have oleophilic surfaces, effect a thorough emulsification of the dampening fluid and printing ink. The several dampening transfer rollers are carried by eccentric bushings in spaced, movable lever arms.

DESCRIPTION OF THE PRIOR ART

Various dampening units which are usable with rotary printing machines are generally well-known in the art. These dampening units supply a dampening fluid, such as water, through a path of rollers to a plate cylinder of the printing machine. One such dampening unit is shown in German published unexamined patent application Ser. No. 3526236. In this dampening unit, the dampening fluid is sprayed by a pivoted disk onto a first dampening transfer roller and is then transmitted over a second rubber covered roller and a third plastic-covered roller to a combined inking and dampening forme roller. The several dampening transfer rollers in this prior art device, with the exception of the combined inking and dampening forme roller are in connection with each other through gear teeth. As a consequence, there is produced a considerable amount of wheel slip between the surfaces of the first dampening transfer roller, which has a chrome surface, and the second, rubber-covered roller.

The dampening unit of the above prior art device requires additional rollers to link up the dampening unit with the inking unit. The gears which are used for the drive of the dampening transfer rollers are costly in their construction and thus create additional costs. They also constitute a considerable noise source. Further, wheel slippage between a chrome covered roller and a rubber-covered roller causes a rapid destruction of the rubber-covered roller in the situation where the dampening unit may run dry.

It is generally well-known that dampening units which use a combined inking and dampening forme roller do not operate well with the low quality types of ink which are often used for newspaper printing. This is because the dampening fluid gets into the inking unit in greater quantities. This has a consequence of loss of quality when these lower-quality inks are utilized.

A dampening unit which uses a pure dampening forme roller is shown in German utility model No. 7814099. In this device, the forme roller receives the dampening fluid from a prior chrome roller which is in slipping contact with a dampening transfer roller. This dampening transfer roller has a melton covering and is dampened by a first roller onto which the dampening fluid is sprayed.

In this second prior art device the dampening transfer roller which is provided with the melton-covering can easily be smeared by ink rests. Additionally, the wheel or surface slippage between the chrome surfaced roller and the melton-covered roller is likely to destroy the melton-covering if the dampening unit should run dry. Further, in this prior art device the emulsification of the ink and the dampening fluid takes place mainly on the surface of the forme roller due to the positioning of the chrome surface roller.

It will thus be apparent that there is a need for a dampening unit having a pure dampening forme roller which overcomes the disadvantages of the prior art devices. The dampening system of the present invention, as will be discussed subsequently, provides such a device and is a substantial improvement over prior art devices.

SUMMARY OF THE INVENTION

It is an object of the present invention to provide a dampening system.

A further object of the present invention is to provide a brush-type dampening system.

Another object of the present invention is to provide a dampening fluid spray system.

A still further object of the present invention is to provide a dampening system having a pure dampening forme roller.

Yet another object of the present invention is to provide a dampening system having at least three successive rollers with oleophilic surfaces.

Even still a further object of the present invention is to provide a dampening system in which the dampening transfer rollers are adjustably supported.

As will be discussed in greater detail in the description of the preferred embodiment that is set forth subsequently, the dampening system in accordance with the present invention utilizes a dampening fluid pan roller to remove dampening fluid from a fluid pan. A brush roller removes the fluid from the pan roller and throws it as fine drops onto a first dampening fluid transfer roller which has a hydrophilic surface, such as chrome. This first transfer roller is followed by several subsequent dampening transfer rollers and a dampening forme roller, all of which are provided with oleophilic surfaces. These several dampening fluid transfer rollers and the dampening forme roller are supported by spaced arms which carry several eccentric bushing assemblies. Movement of these arms affects the amount of contact pressure between the adjacent rollers.

A particular advantage of the dampening system of the present invention resides in the fact that the dampening fluid, in its path of travel from the spray system to the plate cylinder, is able to form an emulsion on the oleophilic surfaces of the dampening transfer rollers. There are provided several squeeze sections between the rollers and this intensifies this positive emulsion effect.

A further advantage of the dampening system of the present invention is that there is no need for additional drives for the dampening forme rollers and thus for any artificially produced wheel slip. This results in a greater durability and life of the dampening unit rollers and a reduced noise level. Since there are fewer gears meshing with each other, there is less gear noise. The use of different diameters for the several dampening rollers prevents a double image so that there is a prevention of the mackling effect which is apt to occur in prior art devices.

The support of the several dampening transfer rollers by eccentrics in spaced levers ensures the exact alignment of impression pressures between the several dampening unit cylinders and the plate cylinder. This adjustment can be made by the use of hydraulic cylinders and adjustable stops.

The dampening system of the present invention provides a quiet, non-destructive dampening system which allows accurate adjustment of contact pressures and thorough ink-dampening fluid emulsification. As such, the dampening system of the present invention is a significant advance in the art.

BRIEF DESCRIPTION OF THE DRAWINGS

While the novel features of the dampening system in accordance with the present invention are set forth with specificity in the appended claims, a full and complete understanding of the invention may be had by referring to the detailed description of the preferred embodiments which is set forth subsequently, and as illustrated in the accompanying drawings, in which:

DETAILED DESCRIPTION OF PREFERRED EMBODIMENTS

Figure 1:
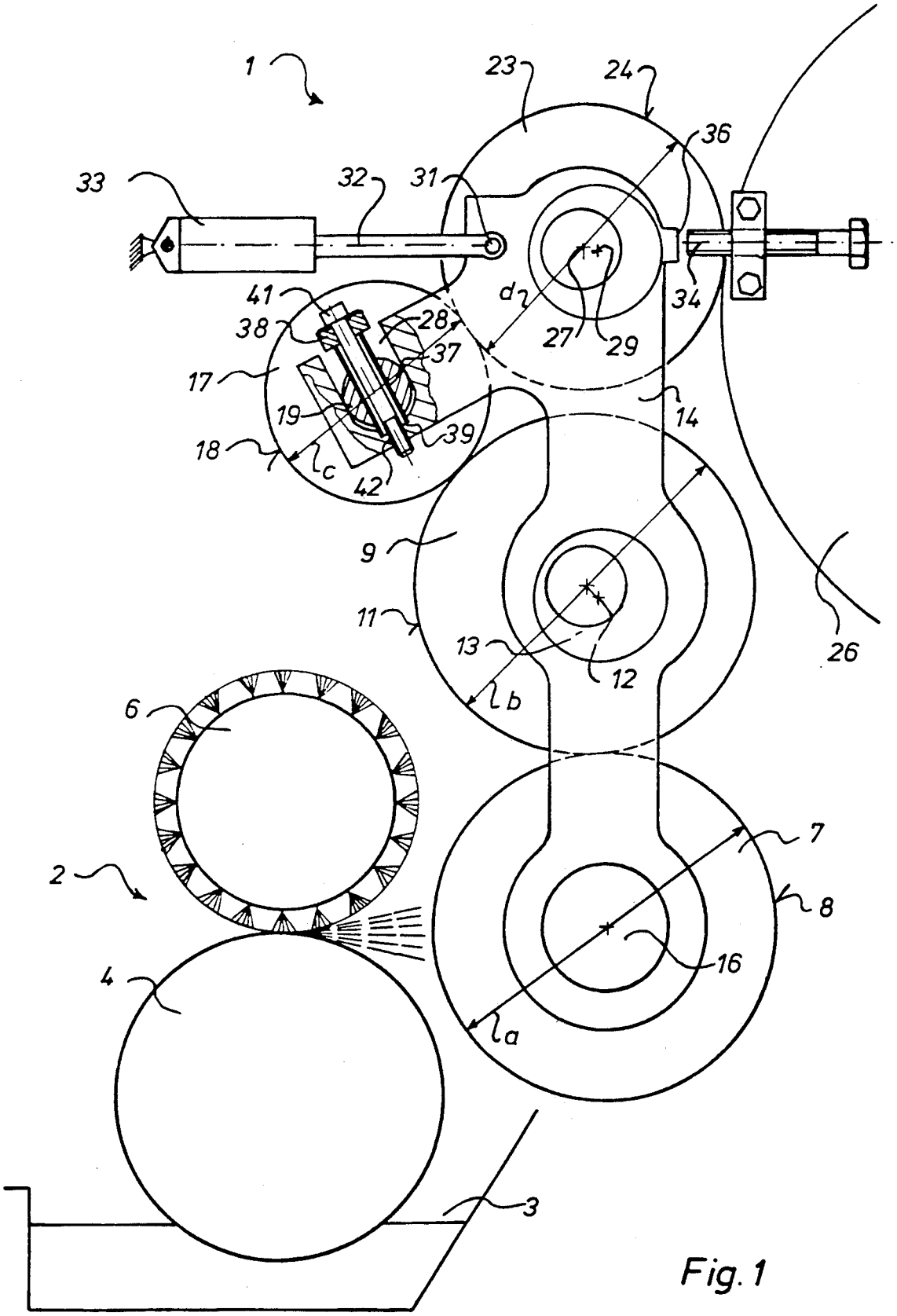
FIG. 1 is a schematic side elevation view of a first preferred embodiment of the brush type dampening system of the present invention.

Referring initially to FIG. 1, there may be seen, generally at 1, a first preferred embodiment of a dampening system for an offset rotary printing press in accordance with the present invention. As may be seen in FIG. 1, the dampening system 1 includes a dampening fluid spray system 2. Spray system 2 is comprised of a dampening fluid pan 3 which carries a wettable dampening fluid, a pivoted dampening fluid pan roller 4, which is immersed in the dampening fluid, and a pivotal brush roller 6. The surface of the brush roller 6 is in contact with the surface of the dampening fluid pan roller 4. Both the pan roller 4 and the brush roller 6 are driven from the drive system for the printing press.

Dampening fluid is taken off the pan roller 4 by the brush roller 6 and is sprayed in the form of fine droplets onto the surface of a first dampening transfer roller 7. This roller 7 has a hydrophilic, preferably chrome-covered surface 8. The first dampening transfer roller 7 is rotatably supported in spaced side frames (not shown) of the printing press and is driven by the drive system of the printing press at machine speed.

The surface 8 of the first dampening transfer roller 7 is in dampening fluid transfer contact with a second dampening transfer roller 9. This second roller 9 has an oleophilic surface 11 which may be, for example, rubber and which may have a hardness in the range of 30°–40° Shore A. This second dampening transfer roller 9 is supported for rotation on an axle 12. This axle 12 is, in turn, supported in eccentric bushings 13 that are carried by spaced levers 14. Each such lever 14 is supported for rotation about a central axle 16 of the first dampening transfer roller 7 which, as was discussed above, is rotatably supported in the side frames (not shown) of the printing press assembly.

The second dampening transfer roller 9 transfers dampening fluid along to a third dampening transfer roller 17 which has an oleophilic surface 18. This surface 18 is preferably a polyamide covered surface 18, such as rilsan, having a hardness of generally 90° Shore D. This third dampening transfer roller 17 is supported by a centrol axle 19 which, as may be seen in FIG. 1, is supported in extension arm portions of spaced levers 14.

The third dampening fluid transfer roller 17 transfers its dampening fluid to a dampening forme roller 23. Dampening fluid is transferred from surface 18 of the third transfer roller 17 to an oleophilic surface 24 of the dampening forme roller 23. This surface 24 may be rubber having a hardness of 30°–40° Shore A. From surface 24, the dampening fluid is carried onto the surface of a plate cylinder 26.

Figure 2:
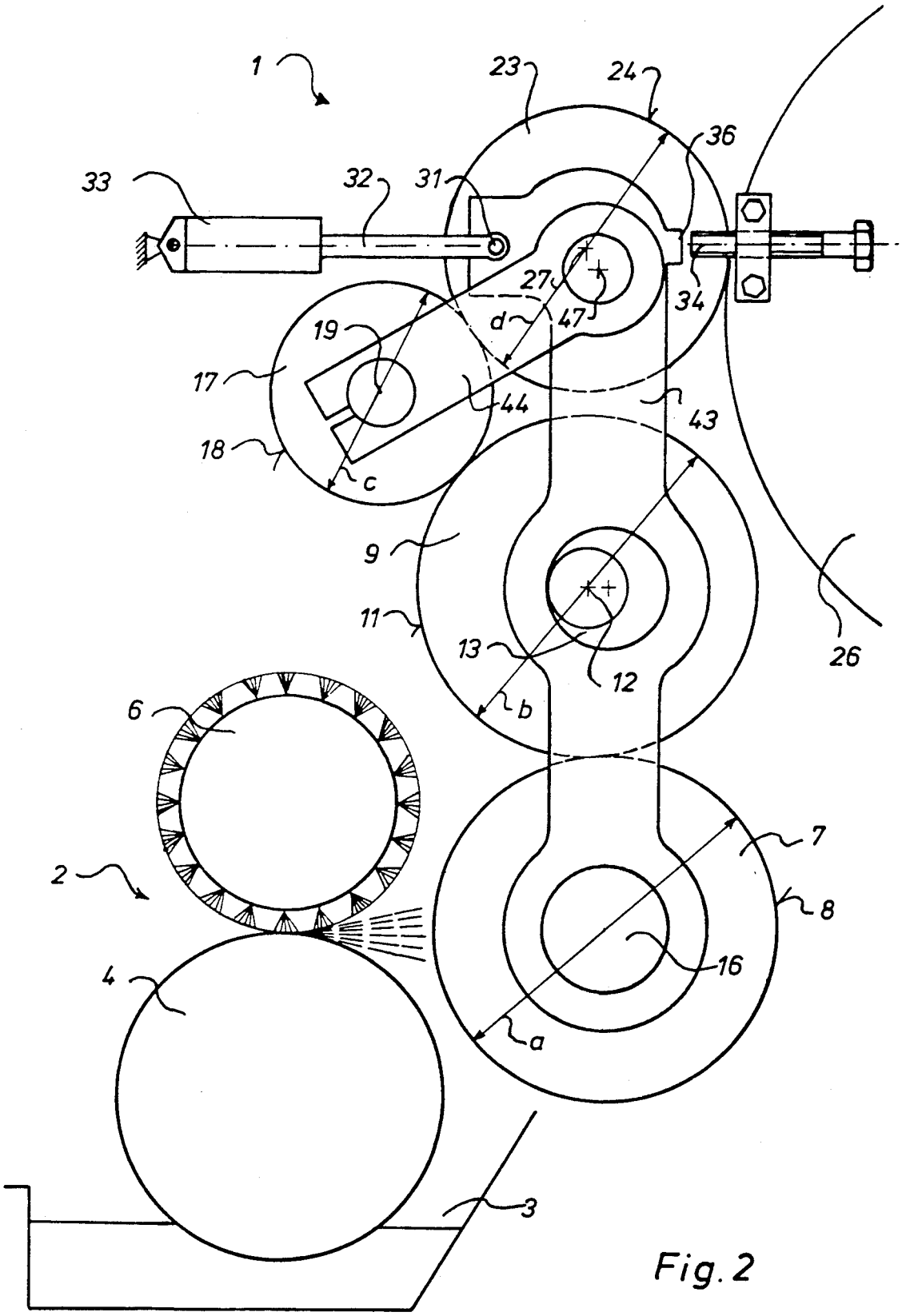
FIG. 2 is a schematic side elevation view of a second preferred embodiment of the brush type dampening system of the present invention.

As may also be seen in FIG. 2, the dampening forme roller 23 is rotatably supported on an axle 27 which is securely supported by eccentric bushings 29 that are, in turn, positioned in the upper ends of the spaced levers 14. This positioning allows the third dampening transfer roller 17 to be shifted with respect to the dampening forme roller 23. An adjustment of the position of the third dampening roller 17 with respect to the second dampening transfer roller 9 can also be effected.

Adjustment of the position of axle 19 of the third dampening transfer roller 17 with respect to the axle 12 of the second dampening transfer roller 9 is accomplished by shifting axle 19 in seats 28 in the levers 14. Each seat 28 supports one end of the axle 19 of the third dampening transfer roller 17. Each end of axle 19 has a generally vertically oriented tapped hole 37. Each one of these tapped holes 37 carries an externally threaded adjustment sleeve 38. The lower ends of the adjustment sleeves 38 are supported on a base portion 39 of the seats 28. Counter screws 41 pass through the interior of each of the adjustment sleeves 38 and are secured into tapped holes 42 which are located at the bases of the seats 28 in the levers 14. The adjustment sleeve 38 may be rotated to shift the position of the axle 19 of the third dampening transfer roller 9 in the arms 14. Once the position of the axle 19 has been set, the counter screws 41 can be used to hold the adjustment sleeves 38 against movement.

The second dampening transfer roller 9 can be shifted with respect to the a first dampening transfer roller 7 by means of the eccentric bushings 13 that support the axle 12 for the second dampening transfer roller 9. Each lever 14 has a seat 31 at an upper end thereof. As seen in FIG. 1, these seats 31 in the two levers 14 each receive a first end of a piston rod 32. The piston rods 32 are extended and retracted by activating cylinders 33 that are pivotably secured to the press side frames. When the piston rods 32 are extended out from the cylinder 33 they press the dampening forme roller 23 against the surface of the plate cylinder 26. Adjustment of this pressure between roller 23 and cylinder 26 is made through two adjustable stops 34 which are secured to the inner surfaces of the side frames 3(not shown) and which can be brought into contact with fixed stops 36 formed on the levers 14.

Figure 3:
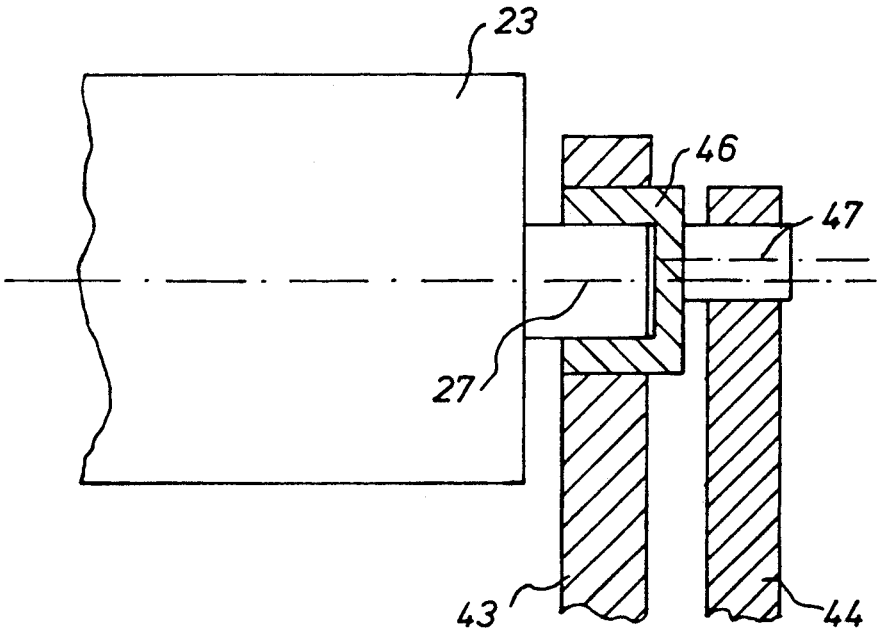
FIG. 3 is a cross-sectional view of the support for the dampening forme roller of FIG. 2.

A second preferred embodiment of the dampening system of the present invention is shown in FIGS. 2 and 3. This second preferred embodiment is generally similar to the first embodiment in overall structure and operation. Hence, the same numbers are used to identify corresponding elements in both embodiments. In this second embodiment, the first and second dampening transfer rollers 7 and 9, and the dampening forme roller 23 are supported between spaced levers 43. The third dampening transfer roller 17 is supported in two separate lever arms 44. As may be seen most clearly in FIG.

2, the axle 19 of third dampening fluid transfer roller 17 is supported in free first ends of the lever arms 44. As may be seen most clearly in FIG. 3, the axle ends 27 of the dampening forme roller 23 are rotatably supported centrally in adjustment bushings 46. Each such adjustment bushing 46 is supported in an aperture in the upper end of a lever 43. Each adjustment bushing 46 is further provided with an eccentrically located journal 47. As may be seen in FIGS. 2 and 3, the second, inner ends of lever arms 44 are secured about these journals 47.

By shifting the adjustment bushing 46, the third dampening transfer roller 127 is adjustable with respect to the dampening forme roller 23. A contact pressure between the third dampening transfer roller 17 and the second dampening transfer roller 9 is produced by the force of gravity which acts upon the dampening forme roller 23.

In operation, the dampening fluid spring system, generally at 2, sprays the dampening fluid, in the form of fine droplets onto the hydrophilic surface 8 of the first dampening transfer roller 7. This first dampening transfer roller 7 is driven by the drive of the printing press so that the peripheral speeds of the first dampening transfer roller and the plate cylinder 26 are equal. The second dampening fluid transfer roller 9 is driven by frictional contact with the first transfer roller 7. Adjustment of the pressure between first and second transfer rollers 7 and 9 is accomplished through the eccentric bushing 13.

Dampening fluid is carried from the oleophilic surface 11 of the second dampening transfer roller 9 to the oleophilic surface 18 of the third dampening transfer roller 17 and from there to the oleophilic surface 24 of the dampening forme roller 23. This dampening fluid is then transferred to the surface of the plate cylinder 26. The dampening forme roller 23 is frictionally driven by the plate cylinder 26 and, in turn, frictionally drives the third dampening transfer roller 17. Both third and first dampening fluid transfer rollers 17 and 7, respectively, effect the frictional drive of the second dampening transfer roller 9.

The three dampening transfer rollers 9, 17, and 23 all have oleophilic coatings 11, 18, and 24, respectively. Thus a film of printing ink is carried back from the plate cylinder 26 through these three oleophilic surface rollers. In accordance with the well-known principle of ink splitting, this ink coating decreases as the distance away from the plate cylinder increases. The dampening fluid, which was transferred to the first dampening fluid transfer roller 7 in the form of drops, can now emulsify with the ink over a relatively long distance or path of travel. Since there are several squeeze points or roller nips along this path of travel, this emulsification will allow the ink to be carried in a "glazed" condition on the plate cylinder. The provision of this ink glaze is quite necessary, particularly for printing units with subsequent dampening devices which do not have the glazing effect that is provided by the dampening system of the present invention.

Referring to either FIG. 1 or 2, it will be seen that the several rollers 7, 9, 17, and 23 have different diameters a, b, c, and d, respectively. As was discussed previously, the provision of these differing diameters prevents the formation of a double impression that would cause the images to be blurred or mackled.

While preferred embodiments of a dampening system in accordance with the present invention have been set forth fully and completely hereinabove, it will be apparent to one of skill in the art that a number of changes in, for example, the sizes of the various rollers, the type of activating cylinder used, the shape of the press side frames and the like could be made without departing from the true spirit and scope of the subject invention, which is accordingly to be limited only by the following claims:

What is claimed is:

1. A dampening system for an offset printing press having a plate cylinder, said dampening system comprising:

a first dampening fluid transfer roller having a hydrophilic surface, said first dampening fluid transfer roller having a first diameter and being rotatable about a first axle having first and second ends;

means for rotatably supporting said first and second ends of said first axle;

means for spraying drops of dampening fluid onto said hydrophilic surface of said first dampening fluid transfer roller;

first and second spaced levers having first ends supported for pivotable movement on said first and second ends of said first axle of said first dampening fluid transfer roller;

a second dampening fluid transfer roller having a surface of an oleophilic soft rubber, said second dampening fluid transfer roller having a second diameter different from said first diameter and being rotatable about a second axle having first and second ends which are rotatably supported in said first and second spaced levers, said surface of said second dampening fluid transfer roller being in frictional drive contact with said surface of said first dampening fluid transfer roller;

a third dampening fluid transfer roller having a hard polyamide surface and having a third diameter different from said first and second diameters, said third dampening fluid transfer roller being rotatable about a third axle having first and second ends which are rotatably supported in said first and second spaced levers, said surface of said third dampening fluid transfer roller being in frictional drive contact with said surface of said second dampening fluid transfer roller;

a dampening forme roller, said dampening forme roller being in frictional drive contact with said plate cylinder out of direct contact with an inking unit for said plate cylinder, said dampening forme roller having a surface of an oleophilic soft rubber and having a fourth diameter different from each of said first, second and third diameters, said dampening forme roller being rotatable about a fourth axle having first and second ends which are rotatably supported in said first and second spaced levers, said surface of said dampening forme roller also being in frictional driving contact with said surface of said third dampening fluid transfer roller and being out of frictional driving contact with said surface of said first and second dampening fluid transfer rollers.

2. The dampening system of claim 1 wherein said rubber surfaces have a hardness of between 30°–40° Shore A.

3. The dampening system of claim 1 wherein said polyamide surface has a hardness of about 90° Shore D.

4. The dampening system of claim 1 wherein said first and second ends of said third axle of said third dampening fluid transfer roller are shiftably supported in said first and second spaced levers.

5. The dampening system of claim 4 wherein said first and second spaced levers have seats and further wherein said first and second ends of said third axle of said third dampening fluid transfer roller are shiftably supported in said seats.

6. The dampening system of claim 1 wherein said first and second ends of said second and fourth axles are supported in eccentric bushings in said first and second layers.

7. The dampening system of claim 5 wherein first and second tapped hole are formed said first and second ends of said third axle of said third dampening fluid transfer roller, wherein first and second externally threaded adjustment sleeves carrying first and second counter screws are carried in said first and second tapped holes, and further wherein first and second tapped bores said first and second seats in said first and second levers receive said first and second counter screw of said corresponding first and second adjustment sleeves whereby said first and second ends of said third axle of said third dampening fluid transfer roller may be shifted in said first and second seats by rotation of said externally threaded adjustment sleeves in said first and second tapped holes.

* * * * *